US005417783A

United States Patent [19]

Boreali et al.

[11] Patent Number: 5,417,783

[45] Date of Patent: May 23, 1995

[54] LINERLESS LABEL DISPENSER

[75] Inventors: Jeffrey J. Boreali, N. Tonawanda; Frank C. DeReu, Tonawanda; Thomas P. Nash, Getzville, all of N.Y.

[73] Assignee: Moore Business Forms, Inc., Grand Island, N.Y.

[21] Appl. No.: 982,699

[22] Filed: Nov. 30, 1992

[51] Int. Cl.[6] ..... A32B 31/00

[52] U.S. Cl. ..... 156/64; 156/247; 156/264; 156/361; 156/568; 225/14; 225/15; 226/127; 226/138

[58] Field of Search ..... 156/354, 64, 264, 299, 156/568, 569, 247, 361; 226/121, 127, 128, 138, 156; 225/12, 14, 15

[56] References Cited

U.S. PATENT DOCUMENTS

| | | | |
|---|---|---|---|
| 1,199,961 | 10/1916 | Bolen . | |
| 2,617,198 | 11/1952 | Sharpe | 225/14 |
| 2,654,154 | 10/1953 | Krueger | 225/14 |
| 2,692,436 | 10/1954 | Krueger | 225/14 |
| 2,695,057 | 11/1954 | Krueger | 164/39 |
| 2,760,572 | 8/1956 | Kreuger | 164/84.5 |
| 2,776,068 | 1/1957 | Johnson | 216/21 |
| 2,972,428 | 2/1961 | Dubbs . | |
| 2,973,890 | 3/1961 | Krueger . | |
| 3,065,889 | 11/1962 | Grosser . | |
| 3,159,521 | 12/1964 | Pechmann | 156/499 |
| 3,565,724 | 2/1971 | Yamaguchi | 156/354 |
| 3,634,175 | 6/1972 | Delle Vite | 156/568 |
| 3,653,539 | 4/1972 | Stageberg | 221/73 |
| 3,730,409 | 5/1973 | Ratti | 225/14 |
| 3,777,962 | 12/1973 | Tange et al. . | |
| 4,124,429 | 11/1978 | Crankshaw | 156/364 |
| 4,189,077 | 2/1980 | Hartbauer et al. | 225/14 |
| 4,467,949 | 8/1984 | Nakata | 226/45 |
| 4,468,274 | 8/1984 | Adachi | 156/320 |
| 4,519,868 | 5/1985 | Hoffmann | 156/353 |
| 4,560,087 | 12/1985 | Sato et al. | 221/73 |
| 4,589,943 | 5/1986 | Kimball et al. | 156/354 |
| 4,637,523 | 1/1987 | Levasseur | 221/13 |
| 4,784,714 | 11/1988 | Shibata | 156/354 |
| 4,786,055 | 11/1988 | Hoffman et al. | 227/127 X |
| 4,943,340 | 7/1990 | Ujimoto et al. | 156/496 |
| 4,953,430 | 9/1990 | Hong . | |
| 4,978,415 | 12/1990 | Jones | 156/517 |
| 4,985,096 | 1/1991 | Bekker-Madsen | 156/354 |
| 5,061,947 | 10/1991 | Morrison et al. | 346/1.1 |

FOREIGN PATENT DOCUMENTS

| | | |
|---|---|---|
| 298248 | 1/1989 | European Pat. Off. . |
| 774715 | 5/1957 | United Kingdom . |
| 2137961 | 10/1984 | United Kingdom . |

*Primary Examiner*—Mark A. Osele
*Attorney, Agent, or Firm*—Nixon & Vanderhye

[57] ABSTRACT

Linerless labels in a continuous web, in roll form, are dispensed. The roll is mounted for rotation by a vertical shaft, and periodically a drive roller with conveyor tapes wrapped around it is rotated to pull the web from the roll in an amount sufficient to unwind approximately one length of label from the roll. The adhesive face of the web engages the circumferential periphery of the drive roller and the conveyor tapes past the drive roller, the exit roller effecting separation of the leading label from the conveyor tapes. An idler roller engages and tensions the web between the roll and the drive roller, and a knife blade is mounted at about the point that the web leaves the drive roller. The components are disposed so that the web engages at least about 170 degrees of the circumferential periphery of the drive roller, with the adhesive face contacting the drive roller circumferential periphery and conveyor tapes. First and second optical sensors sense marks on the web to start and stop rotation of the drive roller so as to unwind one label at a time from the roll, and the roll is automatically braked to prevent the roll continuing to unwind when driving action by the drive means is interrupted.

24 Claims, 4 Drawing Sheets

LINERLESS LABEL DISPENSER

BACKGROUND AND SUMMARY OF THE INVENTION

There are many circumstances in which it is desirable to dispense labels one at a time, especially where an operator applies individual labels to objects. That is, there are many circumstances when manual or semiautomatic dispensing of labels is desirable, and apparatus for effecting that dispensing is well known in the art for dispensing labels mounted on liners (such as exemplified by U.S. Pat. No. 3,653,539).

Recently, there have been substantial developments in the production of linerless labels, which have a number of advantages with respect to labels mounted on liners. While equipment exists for automatically dispensing linerless labels, such as shown in U.S. Pat. Nos. 4,468,274 and 4,978,415, and copending application Ser. No. 07/907,511 filed Jul. 1, 1992, such equipment is relatively complex, and is suited primarily for continuous operation. There is a need for a method and apparatus for dispensing linerless labels periodically or intermittently, so that one label is dispensed at a time, the apparatus operating semiautomatically.

According to the present invention, a method and apparatus are provided for dispensing linerless labels in a continuous web. In the continuous web each label is typically separated from adjacent labels in the web by a line of weakness (perforation), and the web is in roll form. Each label has an adhesive face and a non-adhesive face, the adhesive face typically being on the inside of the roll. The labels are dispensed according to the present invention utilizing simple apparatus in a manner such that one label at a time is exposed and available to be detached from the roll.

According to one aspect of the present invention a method for dispensing linerless labels is provided which comprises the following steps: (a) Mounting the roll for rotation about an axis of rotation. (b) Periodically or intermittently positively pulling the web from the roll an amount sufficient to unwind approximately one length of label from the roll. (c) Exposing a free edge of the leading label in the roll so that it may be grasped. (d) Grasping and pulling on the free edge of the leading label in such a manner so as to separate the leading label from the roll. And (e) after the leading label is separated from the roll, automatically initiating steps (b) and (c) to expose the free edge of the next label in the roll.

Step (b) is typically practiced by engaging the adhesive face of the linerless label with the circumferential periphery of the drive roller so that the web wraps around at least about 170 degree of the circumferential periphery thereof (e.g., about 180–200 degrees), and is further practiced by engaging the adhesive face as and after it engages the circumferential periphery of the drive roller with a plurality of conveyor tapes spaced from each other in a direction parallel to the axis of the rotation of the roll and also after the label passes the circumferential periphery of the drive roller. Step (c) is practiced by separating the leading edge of the web from the conveyor tapes after the web is past the drive roller.

The method is typically practiced utilizing a stationary cutting blade adjacent the web, and step (d) is practiced by manually moving a line of weakness of the web into contact with the cutting blade so as to sever the leading label from a preceding label of the web. Step (e) is typically practiced by automatically sensing the position of the web with respect to the cutting blade utilizing a pair of optical sensors which sense marks on the web which are spaced from each other the length of a label.

The roll is typically automatically braked after step (b) is terminated, and at start-up the position of the web is jogged until the line of weakness of the leading label is aligned with the cutting blade, and the optical sensors are positioned to properly sense unwinding of one length of label at a time.

According to another aspect of the present invention a linerless label dispenser is provided. The dispenser comprises: Means for mounting the roll of linerless labels so that the labels may be pulled from the roll in web form as the roll rotates about a first axis of rotation. Drive means for unwinding the web of linerless labels from the roll, the drive means comprising a drive roller having a circumferential periphery and rotatable about a second axis, parallel to the first axis. An exit roller, rotatable about a third axis, parallel to the second axis. A plurality of endless conveyor tapes extending over a portion of the circumferential periphery of the drive roller and engaging the exit roller, to effect transport of the label web past the drive roller and to and past the exit roller, the conveyor tapes spaced from each other in a direction parallel to the second axis. Separation means for separating the linerless label web from the conveyor tapes. And severing means for severing each label from the next label of the web of linerless labels.

In the dispenser, typically an idler roller is also mounted between the roll mounting means and the drive roller for engaging the non-adhesive face of the web of linerless labels between the roll mounting means and the drive roller circumferential periphery, and tensioning the web. The drive means typically comprises a motor for rotating the drive roller, and there is also provided automatic sensing means for sensing the position of the web from the roll and controlling the motor in response to the sensing. The automatic sensing means typically comprises first and second optical sensors, a first sensor mounted adjacent the drive roller, and a second sensor mounted past the drive roller adjacent the separation means. Typically, control means are provided for controlling operation of the motor in addition to the automatic sensing means, to turn it off, turn it on so that it operates automatically under the influence of the sensors, or to "jog".

The conveyor tapes are wrapped around the exit roller to protrude a first radial distance from the circumferential portion of the exit roller. The separation means comprises rings on the exit roller between the conveyor tapes, the rings protruding a second radial distance from the circumferential portion of the exit roller, the second radial distance being greater than the first radial distance so that the rings peel the label away from the conveyor tapes.

The severing means may comprise a stationary knife blade mounted adjacent the drive roller. The roll mounting means typically includes brake means to prevent the roll from continuing to unwind when driving action by the drive means is interrupted. The drive roller, conveyor tapes, exit roller, roll mounting means and idler roller are typically mounted with respect to each other so that the web from the roll engages at least about 170 degrees of the circumferential periphery of the drive roller, which—combined with the adhesive face of the web engaging the drive roller and conveyor tapes—provides positive unwinding action. The roll mounting means may comprise a substantially vertical shaft, which has a pair of adjustable chucks mounted on it to accommodate various widths of rolls.

It is the primary object of the present invention to provide a simple method and apparatus for semiautomatically dispensing linerless labels. This and other objects of the invention will become clear from an inspection of the detailed description of the invention, and from the appended claims.

DETAILED DESCRIPTION OF THE DRAWINGS

Figure 1:
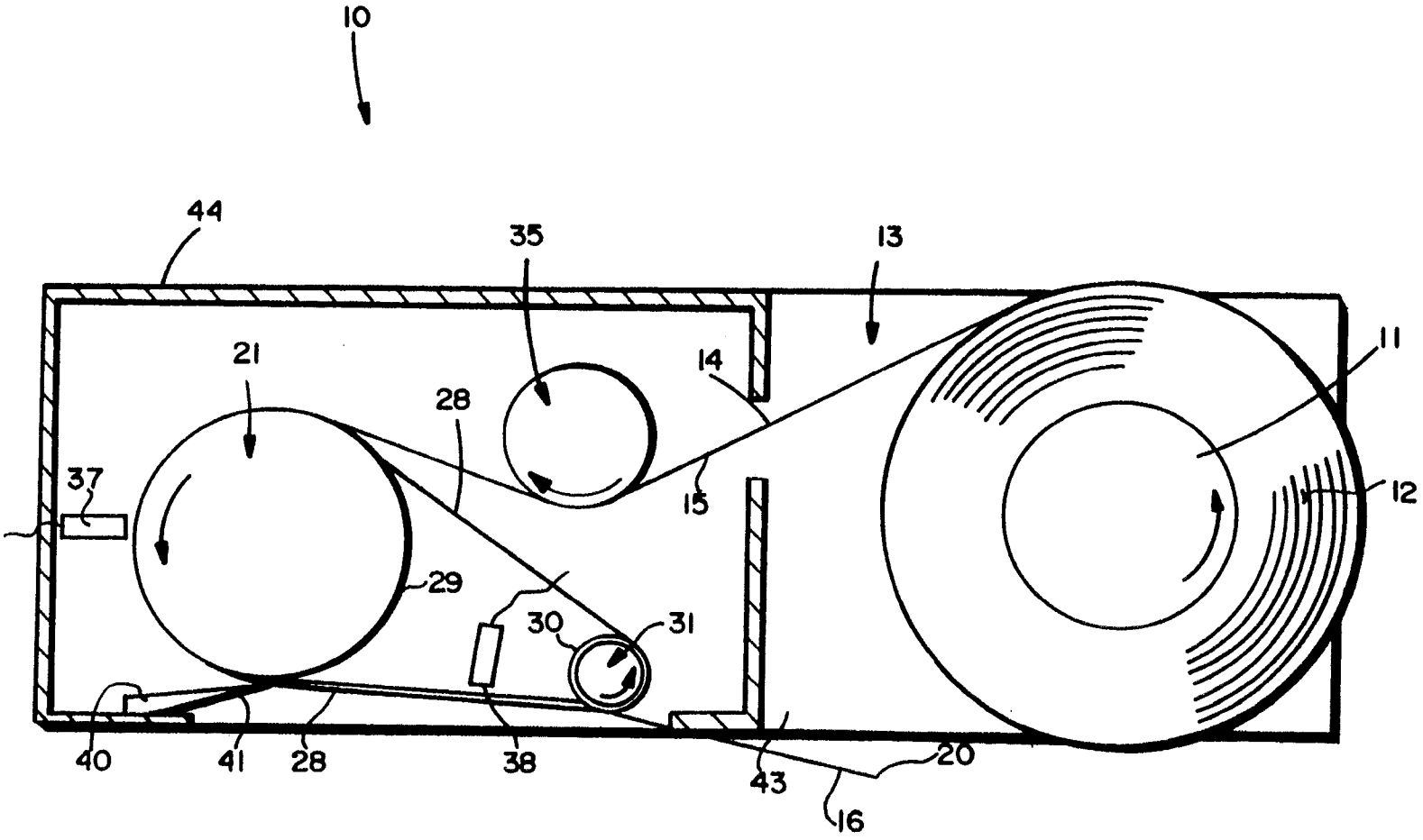
FIG. 1 is a top schematic view of an exemplary apparatus according to the present invention.
Figure 2:
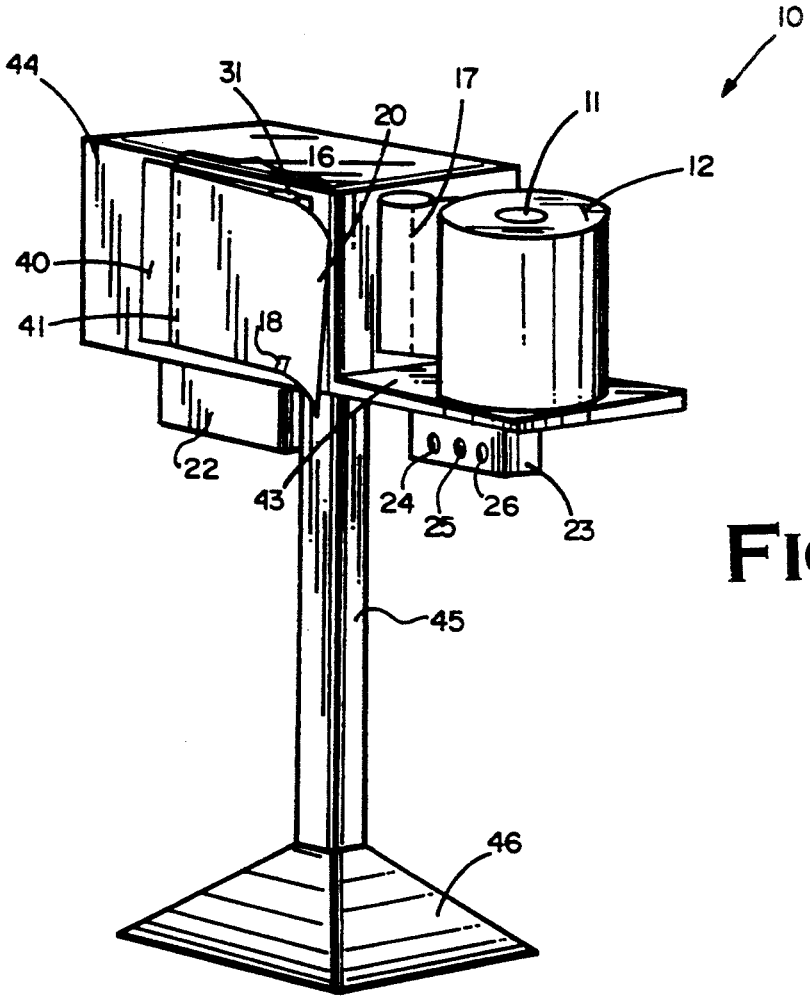
FIG. 2 is a perspective schematic view of the apparatus of FIG. 1.
Figure 4:
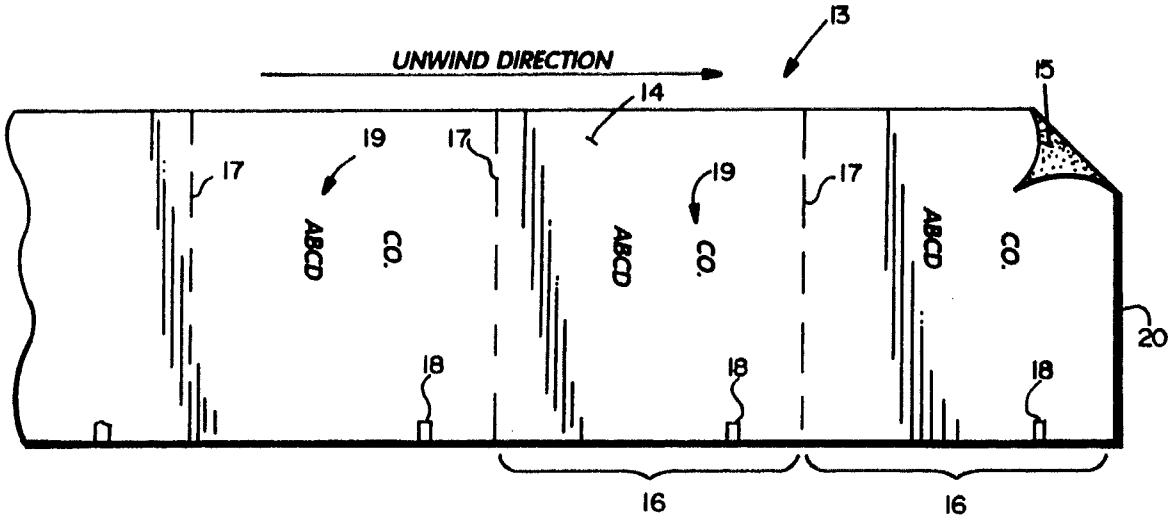
FIG. 4 is a top plan view of an exemplary linerless label web capable of being dispensed by the apparatus of FIGS. 1 through 3.

An exemplary label dispenser according to the present invention, for semiautomatically dispensing linerless labels one at a time, is shown schematically by reference numeral 10 in FIGS. 1 and 2. The dispenser 10 includes a vertical shaft 11 which receives the core of a roll 12 of linerless labels and mounts the roll 12 for rotation about a generally vertical axis so that the labels may be unwound from the roll 12. The linerless labels are in the form of a web, illustrated schematically at 13 in FIGS. 1 and 4, the web having a non-adhesive face 14, and an adhesive face 15. Also, preferably each label 16 is separated from each other label 16 of the web 13 by a line of weakness, such as a perforation line 17. As shown in FIG. 4, each label 16 preferably has a sensor mark 18 associated therewith, the marks 18 being positioned exactly the same spacing from the perforation 17 in each of the labels 16 (that is the marks 18 being spaced apart the length of one label 16). Typically, indicia 19 is printed on the non-adhesive face 14 of the web 13. As seen in FIGS. 1 and 4, the leading label 16 has a leading, free edge, 20 thereof which is adapted to be grasped to facilitate detachment of the leading label 16 from the next label 16.

The vertical shaft 11 preferably includes a conventional brake unwind (not shown in detail) associated with it. The conventional brake unwind typically is a friction brake which prevents the roll from continuing to unwind once the pulling force on the web has terminated.

A major component of the dispenser 10 is the drive roller 21, which is mounted for rotation about an axis parallel to the shaft 11 (e.g., vertical), and is driven by a motor 22 which is controlled by a control box 23. The control box 23 typically will have two actuators 24, 25. The first actuator 24 is an emergency "stop" button. The second actuator 25 is a three position switch. The three positions include an "off" position, a "jog" position, and an "auto" position. The "jog" position effects intermittent operation and the "auto" position places the motor in a condition to be operated automatically, as will be hereinafter described.

Figure 3:
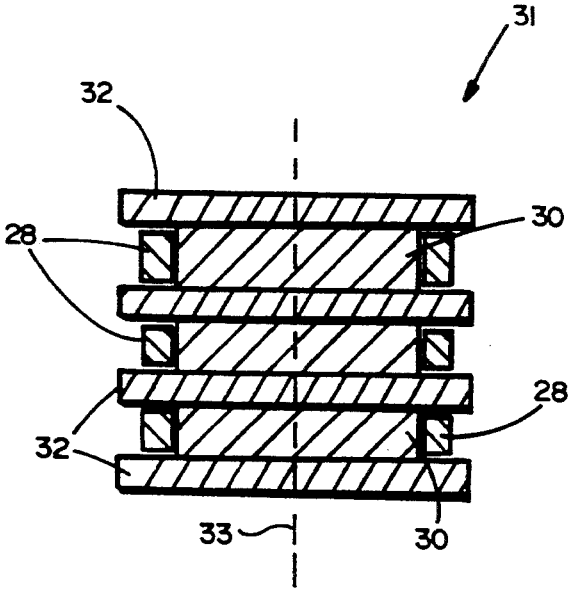
FIG. 3 is a longitudinal cross-sectional view of an exemplary exit roller utilized with the apparatus of FIGS. 1 and 2.

Associated with the drive roller 21 there preferably are a plurality of conveyor tapes, the top one of which is shown by reference numeral 28 in FIG. 1, and a number of which are shown in cross-section in FIG. 3. The tapes 28 are wrapped around the circumferential periphery 29 of the drive roller 21, and around a circumferential portion 30 of an exit roller 31. The exit roller 31 is mounted for rotation about an axis parallel to the axis of rotation of the drive roller 21. The conveyor tapes 28 are spaced from each other axially along the length of the rollers 21, 31 (see FIG. 3).

The exit roller 31 is constructed so as to effect separation of the leading label 16 of the web 13 from the conveyor tapes 28. This is provided by the construction illustrated in FIG. 3. The exit roller 31 illustrated in FIG. 3 is shown having three conveyor tapes 28, although any number can be provided. Associated with the roll 31 are a plurality of rings 32. The rings 32 have a diameter greater than the diameter of the circumferential portions 30 which engage the conveyor tapes 28, plus the thickness of the conveyor tapes 28. That is, the rings 32 extend radially from the center line 33 of the exit roller 31 a distance greater than the radial distance that the conveyor tapes 28 protrude from the center line 33. Thus, the label 16 adhesive face 15 will engage the rings 32 at the exit roller 31 and be detached from the conveyor tapes 28 thereby.

The dispenser 10 also preferably comprises an idler roller 35 mounted for rotation about an axis parallel to the axis of the drive roller 21, and engaging the non-adhesive face 14 of the web 13 between the shaft 11 and the drive roller 21. The idler roller 35 is positioned or biased so that it tensions the web 13 between the drive roller 21 and the shaft 11.

The invention is particularly suitable for use with webs 13 of linerless labels in which the adhesive on the adhesive face 15 is a repositional adhesive, such as CLEANTAC® adhesive sold by Moore Business Forms of Lake Forest, Ill. If repositional adhesive is utilized, typically the drive roller 21, circumferential periphery 29 and the conveyor tapes 28 need not be treated with special materials in order to properly release the adhesive. However, if the adhesive of the face 15 is more tacky or permanent than a repositional adhesive, it may be desirable to make the conveyor tapes 28, circumferential surface 29, and especially rings 32, of a release material, or coat them with a release material, such as polytetrafluoroethylene, so as to minimize the possibility of the adhesive permanently sticking to the components.

In order to control operation of the motor 22 so that one label 16 is dispensed at a time from the dispenser 10, automatic sensing means are provided. Typically, the automatic sensing means take the form of a first optical sensor 37, and a second optical sensor 38. The sensor 37 is mounted adjacent the portion of the drive roller 21 which is engaged by the web 13, while the second optical sensor 38 is mounted adjacent the conveyor tapes 28 past the point where conveyor tapes 28 engage the circumferential periphery 29 of the drive roller 21. The optical sensor 38 will be positioned so that it is between two conveyor tapes 28, so that it will sense either the presence or absence of a label 16 engaging the conveyor tape 28.

The dispenser 10 also preferably comprises some mechanism for severing one label 16 from the next. While an automatic severing means such as a rotary blade, anvil, shears, guillotine, or the like, may be utilized, it is preferred to use a stationary knife 40 having a knife edge 41 which is mounted adjacent the point where the web 13 moves off the surface of the circumferential periphery 29 of the drive roller 21.

The dispenser 10 also comprises means for mounting the components—such as the shaft 11, rollers 21, 31, 35, etc.—so that during normal operation the web 13 engages a substantial amount of the circumferential periphery 29 of the drive roller 21. It is important for the web 13 to engage a substantial portion of the circumferential periphery 29 (and typically also the conveyor tapes 28 thereat) so that positive driving action of the web 13 by the drive roller 21 is provided. Of course, the fact that the adhesive face 15 also engages the circumferential portion 29 assists in this driving action. It is preferred that the web 13 engage at least about 170 degrees of the circumferential periphery 29, e.g., about 180 degrees or—as illustrated in FIG. 1—about 200 degrees. [Of course, in addition to positioning of the components 21, 31, 35, etc., the diameters of the components 31, 35 with respect to the drive roller 21 may be adjusted to provide the desired circumferential engagement.] Such mounting means may comprise a plate 43, which—in the embodiment illustrated in FIGS. 1 and 2—is generally horizontal. A housing 44 may also be provided (see FIG. 2) covering the components 21, 35, except at the area of the knife 40 and exit roller 31. Also, the dispenser 10 may be easily mounted by a single vertical support 45, having a base 46, comprising a dispenser stand, as seen in FIG. 2. Alternatively, the dispenser 10 may be easily mounted on a structural steel tubing stand. The stand provides the stability for the dispenser as well as a "walk-over" feature at the base. The base may extend out into the walk way. A walk-over plate, on the base may be provided so as to not interrupt the flow of traffic through the walk way. The walk-over plate also provides extra stability to the stand. When an operator wishes to disperse or extract a label he is encouraged to step up on the walk-over plate. The weight of the operator further stabilizes the entire unit.

In the operation of the apparatus heretofore described, with power off a roll 12 is placed in association with the shaft 11 and the web 13 is manually unwound so as to pass around the drive roller 21. Once the web 13 passes through the dispenser 10 the operator restores power to the motor 22, and turns the three position switch 25 to the "jog" position to advance the web 13 to the point where the perforation 17 of the leading label 16 is lined up with the knife edge 41. At this point the operator adjusts the position of the first sensor 37 (which may be mounted on any conventional adjustment mechanism) so that it is in alignment with the mark 18 on the next label 16 of the web 13, the adjustability of the sensor 37 allowing marks located within two to five inches of the previous perforation 17 to be sensed, so that any label having a length greater than about three inches may be dispensed. Once the sensor 37 is so positioned, the switch 25 is turned to the "auto" position, and the dispenser 10 is now ready to operate.

In normal operation of the dispenser 10, the operator grasps the leading label 16 adjacent the free edge 20 thereof, and pulls downwardly and sidewardly, causing the label 16 to detach from the next label along the perforation 17, assisted by the engagement of the knife edge 41 by the perforation 17. The operator then applies the detached label to any desired object. When the leading label 16 has been detached, this is sensed by the second sensor 38, which starts operation of the motor 22 to drive the drive roller 21 and pull on the web 13, unwinding it from the roll 12. Unwinding action takes place until the first sensor 37 senses the mark 18 on the next label 16, which then automatically stops operation of the motor 22. Because of the conventional friction brake associated with the shaft 11, unwinding action of the roll 12 also is immediately terminated when motor 22 stops. This action continues until all labels on the roll 12 have been dispensed.

Figure 5:
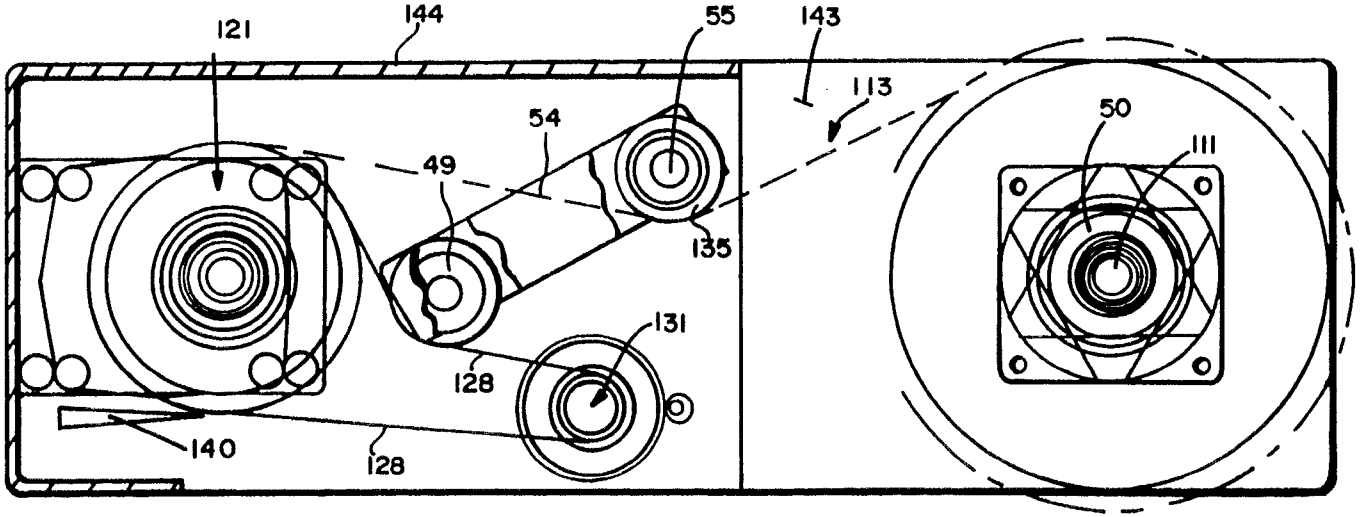
FIG. 5 is a top plan view, with the linerless label roll removed, of a modified form of apparatus according to the present invention.
Figure 6:
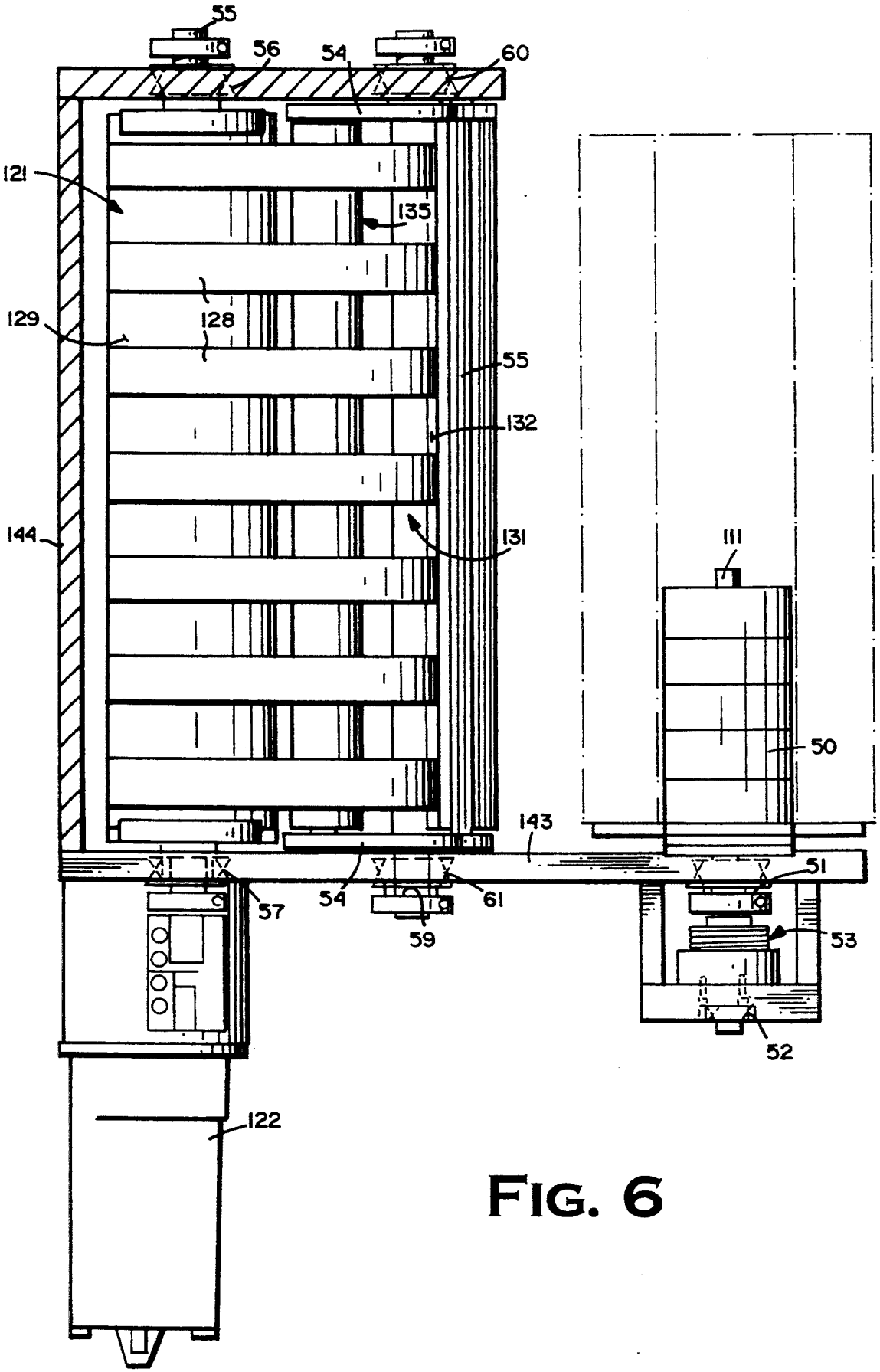
FIG. 6 is a side view of the apparatus of FIG. 5.

FIGS. 5 and 6 illustrate a slightly modified form of the dispenser 10 major components. In the FIGS. 5 and 6 embodiment the same structures as illustrated in the FIGS. 1 through 3 embodiment are shown by the same reference numerals, only preceded by a "1".

In the embodiment of FIGS. 5 and 6, the shaft 111 is shown having an easy mount label roll core holder. The core holder consists of alternating series of fins on a hexagonal arc—shown generally at 50 in FIGS. 5 and 6—which allow easy installation and removal of the label roll but also provide a positive driving mechanism when the roll is engaged. Note that the shaft 111 is mounted by bearings 51, 52, and the conventional friction brake mechanism is shown schematically at 53.

In the FIGS. 5 and 6 embodiment, the belt idler roller 49 is mounted at the end of arms 54, which are mounted for rotation about shaft 55 on the same axis as idler roller 135 (i.e. parallel to the shaft 111). Roller 135 engages web 113. A locking mechanism on arms 54 secures the position of the arms to shaft 55 to provide a positive force on roller 135 toward contact with the conveyor tapes 128 between the drive roller 121 and the shaft 111.

The drive roller 121 is mounted by an inner shaft 55 which in turn is mounted by bearings 56 in a top portion of the housing 144, and bearings 57 in the plate 143, and is connected to the motor 122. The roller 121 has recesses formed along the surface corresponding to the positions of the conveyor tapes 128 so that the tapes 128 do not radially protrude from the circumferential surface 129 of the roller 121 at the points where the tapes engage it, but rather the tapes 128 are substantially flush with the circumferential periphery 129. The roller 131 also is mounted by turning down the ends of roller 131 to the proper diameter, mounted on the upper portion of the housing 144 by bearing 60, and in the plate 143 by bearing 61. In FIGS. 5 and 6 the sensors are not shown, but they are positioned in the same manner as illustrated in FIG. 1.

It will thus be seen that according to the present invention a simple method and apparatus are provided for semiautomatically dispensing linerless labels. While the invention has herein been shown and described in what is presently conceived to be the most practical and preferred embodiment thereof, it will be apparent to those of ordinary skill in the art that many modifications may be made thereof within the scope of the invention, which scope is to be accorded the broadest interpretation of the appended claims so as to encompass all equivalent structures and methods.

What is claimed is:

1. A method for dispensing linerless labels in a continuous web, each label separated from adjacent labels in the web by a line of weakness, the web being in roll form with each label having a pressure sensitive adhesive face and a non-adhesive face, the pressure sensitive adhesive face on the inside of the roll, comprising the steps of:

(a) mounting the roll for rotation about an axis of rotation;

(b) periodically or intermittently positively pulling the web from the roll an amount sufficient to unwind approximately one length of label from the roll;

(c) exposing a free edge of the leading label in the roll so that it may be grasped;

(d) grasping and pulling on the free edge of the leading label in such a manner so as to separate the leading label from the roll by manually moving the line of weakness of the web into contact with a stationary cutting blade, positioned one label length upstream from the exposed free edge of the leading label, so as to sever the leading label from a proceeding label of the web; and (e) after the leading label is separated from the roll, automatically in response to that separation initiating steps (b) and (c) to expose the free edge of the next label in the roll.

2. A method as recited in claim 1 wherein step (b) is practiced by engaging the pressure sensitive adhesive face of the linerless label web with the circumferential periphery of a drive roller so that the web wraps around at least about 170° of the drive roller circumferential periphery.

3. A method as recited in claim 2 wherein step (b) is further practiced by engaging the pressure sensitive adhesive face as and after it engages the circumferential periphery of the drive roller with a plurality of conveyor tapes spaced from each other in a direction parallel to the axis of rotation of the roll, and themselves engaging the circumferential periphery of the drive roller.

4. A method as recited in claim 3 wherein step (c) is practiced by separating the leading edge of the web from the conveyor tapes after the web is past the drive roller.

5. A method as recited in claim 4 wherein step (e) is practiced by automatically sensing when the leading label has been separated from the rest of the web.

6. A method as recited in claim 5 wherein the sensing of step (e) is practiced optically.

7. A method as recited in claim 6 wherein the web has a plurality of marks thereon, the marks being spaced from each other a distance equal to the length of a label, and wherein said sensing step is practiced by optically sensing the positions of the marks.

8. A method as recited in claim 1 wherein step (e) is practiced by automatically sensing the position of the web with respect to the cutting blade.

9. A method as recited in claim 1 comprising the further step of automatically braking the roll after step (b) is terminated.

10. A method as recited in claim 1 comprising the further step, at start-up, of jogging the position of the web until the line of weakness of the leading label is aligned with the cutting blade.

11. A linerless label dispenser for dispensing linerless labels in web and roll form, the labels having a pressure sensitive adhesive face and a non-adhesive face, comprising:

means for mounting the roll of linerless labels so that the labels may be pulled from the roll in web form as the roll rotates about a first axis of rotation;

drive means for engaging the web of linerless labels from the web from the roll, said drive means comprising a single drive roller having a circumferential periphery and rotatable about a second axis, parallel to said first axis;

an exit roller, rotatable about a third axis, parallel to said second axis;

a plurality of endless conveyor tapes extending over a portion of the circumferential periphery of said drive roller and engaging said exit roller, to effect transport of the label web past said drive roller and to and past said exit roller, said conveyor tapes spaced from each other in a direction parallel to said second axis;

separation means for separating the linerless label web from said conveyor tapes; and manual severing means, positioned upstream of the exit roller, for severing each label from the next label of the web of linerless labels.

12. A dispenser as recited in claim 11 further comprising an idler roller mounted between said roll mounting means and said drive roller for engaging the non-adhesive face of the web of linerless labels between said roll mounting means and said drive roller circumferential periphery, and tensioning the web thereat.

13. A dispenser as recited in claim 11 wherein said drive means further comprises a motor for rotating said drive roller; and further comprising automatic sensing means for sensing the position of the web from the roll and controlling said motor in response to said sensing.

14. A dispenser as recited in claim 13 wherein said automatic sensing means comprises first and second optical sensors, said first sensor mounted adjacent said drive roller, and said second sensor mounted past said drive roller, adjacent said separation means.

15. A dispenser as recited in claim 11 wherein said conveyor tapes are wrapped around said exit roller to protrude a first radial distance from a circumferential portion of said exit roller; and wherein said separation means comprises a plurality of rings on said exit roller between said conveyor tapes, said rings protruding a second radial distance from said circumferential portion of said exit roller, said second radial distance greater than said first radial distance.

16. A dispenser as recited in claim 11 wherein said severing means comprises a stationary knife blade mounted adjacent said drive roller.

17. A dispenser as recited in claim 11 wherein said roll mounting means comprises brake means to prevent the roll from continuing to unwind when driving action by said drive means is interrupted.

18. A dispenser as recited in claim 11 further comprising means for mounting said drive roller, conveyor tapes, exit roller, and roll mounting means with respect to each other so that the web from the roll engages at least about 170 degrees of circumferential periphery of said drive roller.

19. A dispenser as recited in claim 11 wherein said drive means further comprises a motor for rotating said drive roller; and further comprising control means for controlling operation of said motor to turn it off, turn it on so that it operates automatically, or to jog.

20. A dispenser as recited in claim 19 further comprising automatic sensing means for sensing the position of the web of linerless labels and control operation of said motor in response to said sensing.

21. A dispenser as recited in claim 11 wherein said roll mounting means comprises a substantially vertical shaft.

22. A dispenser as recited in claim 21 wherein said vertical shaft includes a pair of adjustable chucks mounted thereon to accommodate various widths of rolls.

23. A dispenser as recited in claim 11 wherein said drive means further comprises a motor for rotating said drive roller; and an idler roller mounted between said roll mounting means and said drive roller for engaging the non-adhesive face of the web of linerless labels between said roll mounting means and said drive roller circumferential peripheral, and tensioning the web thereat;

first and second optical sensors comprising means for sensing the position of the web from the roll and controlling said motor in response to said sensing;

brake means to prevent the roll from continuing to unwind when driving action by said drive means is interrupted; and means for mounting said drive roller, conveyor tapes, exit roller, and roll mounting means with respect to each other so that the web from the roll engages a substantial circumferential periphery of said drive roller.

24. A linerless label dispenser for dispensing linerless labels in web and roll form, the labels having a pressure sensitive adhesive face and a non-adhesive face, comprising:

means for mounting the roll of linerless labels so that the labels may be pulled from the roll in web form as the roll rotates about a first generally vertical axis of rotation;

drive means for engaging the web of linerless labels from the roll to pull the web from the roll, said drive means comprising a drive roller having a circumferential periphery and rotatable about a second axis, parallel to said first axis;

an exit roller, rotatable about a third axis, parallel to said second axis;

a plurality of endless conveyor tapes extending over a portion of the circumferential periphery of said drive roller and engaging said exit roller, to effect transport of the label web about the drive roller and to and past the exit roller; and separation means for separating the linerless label web from the conveyor tapes; and manual severing means, positioned upstream of the exit roller, for severing each label from the next label of the web of linerless labels.

* * * * *